US006023027A

United States Patent [19]

Neff

[11] Patent Number: 6,023,027

[45] Date of Patent: Feb. 8, 2000

[54] CABLE GUARD HAVING A HINGE ROD AND FOR PROTECTING CABLES EXTENDING ALONG A TUBING STRING

[76] Inventor: Scott E. Neff, 10031 E. 52nd St., Tulsa, Okla. 74146

[21] Appl. No.: 08/642,575

[22] Filed: May 3, 1996

[51] Int. Cl.[7] ..... H01B 07/24

[52] U.S. Cl. ..... 174/136; 138/159; 138/110; 166/242.3; 175/325.7

[58] Field of Search ..... 174/136, 68.3, 174/35 TS, 726, 100; 138/158, 159, 156, 110; 285/137.1, 119; 175/325.1, 325.7; 166/242.3; 439/165; D13/154, 155

[56] References Cited

U.S. PATENT DOCUMENTS

| | | | |
|---|---|---|---|
| D. 301,333 | 5/1989 | Bongard et al. | D13/156 |
| D. 317,150 | 5/1991 | Schmidt et al. | D13/154 |
| D. 317,298 | 6/1991 | Schmidt et al. | D13/154 |
| D. 369,589 | 5/1996 | Neff et al. | D13/154 |
| 2,451,004 | 10/1948 | Van Antwerp | 174/41 |
| 3,871,731 | 3/1975 | LaCoursiere, Sr. et al. | 439/369 |
| 4,097,105 | 6/1978 | Zumwalt | 439/369 |
| 4,184,732 | 1/1980 | Hudson | 439/369 |
| 4,199,011 | 4/1980 | Kreft et al. | 138/157 |
| 4,248,459 | 2/1981 | Pate et al. | 285/319 |
| 4,543,998 | 10/1985 | Thomerson | 138/110 |
| 4,601,334 | 7/1986 | Lovegrove | 166/241.7 |
| 4,796,670 | 1/1989 | Russell et al. | 138/110 |

*Primary Examiner*—Kristine Kincaid
*Assistant Examiner*—Kamand Cuneo
*Attorney, Agent, or Firm*—Crowe & Dunlevy, P.C.; Bill D. McCarthy; Phillip L. Free, Jr.

[57] ABSTRACT

A guard for cables that extend alongside a coupling in a tubing string includes a base and a clamp member that are hingedly interconnected to fit about the coupling and portions of the cables beside the coupling. Hinge elements, formed on sections of the clamp member at opposite ends of the guard and received by hinge grooves formed in end members of the base, are connected together by a hinge rod and a projection on a rib connecting the base end members extends partially about central portions of the hinge rod to secure the hinge elements within the hinge grooves. Bolt grooves are formed in free ends of the base end members opposite hinge ends of the base members in which the hinge grooves are formed to receive the ends of a base portion of a u-bolt that is secured to the base by a projection formed on a rib connecting the base end members and extending partially about the base portion of the u-bolt. The legs of the u-bolt extend through recesses formed in the free ends of the base end members and free ends of the clamp sections opposite the hinge connection of the base and clamp member and nuts threaded onto the u-bolt legs secure the guard in position about the coupling and the cables.

4 Claims, 4 Drawing Sheets

CABLE GUARD HAVING A HINGE ROD AND FOR PROTECTING CABLES EXTENDING ALONG A TUBING STRING

BACKGROUND OF THE INVENTION

1. Field of the Invention

The present invention relates generally to improvements in protective devices, and, more particularly, but not by way of limitation, to improvements in guards for protecting downhole pump power and control cables in the passage of the cables by couplings between tubes of a tubing string extending down a bore hole to the pump.

2. Brief Description of the Prior Art

As is well known in the art, the standard practice in the drilling of an oil well has been to locate a drilling rig on the earth's surface directly above an oil deposit and drill directly downwardly from the surface into the deposit. Oil can then be recovered using a downhole mechanical pump that is operated via a string of sucker rods by a pump jack at the well head.

However, in some circumstances, such an approach cannot be utilized; for example, manmade or natural obstacles may interfere with the positioning of drilling equipment directly above the deposit. In such cases, the deposit can be reached using so-called directional drilling in which the bore hole is caused to follow a curving path to the deposit from a location that may be some horizontal distance from the deposit. Oil is subsequently recovered using a downhole, electrically operated pump that is mounted on the end of a tubing string that extends from the well head into the deposit.

While directional drilling and electrical pumping have permitted the recovery of oil from deposits which could not otherwise be reached and, moreover, has permitted more efficient recovery of oil, they have also given rise to a problem which is not encountered in wells that extend directly downwardly from the surface. Electrical power used to operate the downhole pump is supplied via power cables that extend along the tubing string from the earth's surface to the pump and these cables, as well as electrical control cables, can be damaged in the process of inserting the tubing string into the well. In particular, the tubing string is comprised of a series of tubes that are connected together by couplings which have outside diameters that exceed the diameters of the tubes and these couplings engage the well casing in following the curved path to the oil deposit. If an electrical cable is caught between a coupling and the casing, it will be subjected to crushing and abrasion that can cause breakage of electrical conductors within the cable. Since the pump must be removed from the well any time servicing or repair of the pump is required and then reintroduced into the well, the problem can potentially occur at any of a number of occasions during the productive lifetime of a well.

While electrical cables used in the operation of a downhole pump are commonly armored to minimize the problem of damage to the cables, armoring has not proved to be an adequate solution to the problem. Consequently, it has been proposed that cable guards, mountable on the couplings and having internal channels for passing the cables past the couplings, be provided for protecting those portions of the cables at which damage is likely to occur; that is, portions of the cables positioned alongside the couplings. More particularly, the cable guards would be comprised of a base, extendable about one side of the coupling and including channels for the cables in surfaces of the base that engage the coupling, and a clamp member that is hinged to the base, along one side of the guard, and extends about the opposite side of the coupling. Bolts can then be used to connect distal portions of the clamp member to the base so as to rigidly secure the guard about the coupling.

While the use of such guards has the potential of providing a complete solution to the problem of electrical cable damage, the use of such guards presents problems in its own right. In order that a cable guard be capable of carrying out its function of protecting an electrical cable in the passage of the cable about a tubing coupling, the guard must have a substantial construction. Consequently, since several hundred guards can be required for a single well, the use of such guards would not be an inconsequential expense in the production of oil even though the guards would be reusable. Wear occasioned by movement of a guard along a well casing each time it is mounted on a tubing string, whether in the same or a different well, can eventually lead to breakage that will require replacement of the guard. Similarly, because of the number of guards required to protect the cables in a single well, labor costs associated with the installation of the guards on a tubing string can unduly increase expenses of oil well operation.

SUMMARY OF THE INVENTION

The present invention provides a cable guard that minimizes not only costs associated with acquisition and maintenance of the guards but also costs that are associated with installation of the guards on a tubing string. To the first of these ends, the guards are provided with a capability for ready assembly and disassembly that facilitates replacement of worn or damaged parts of guards to eliminate disposal of other parts that are still serviceable. Consequently, guard replacement costs can be held to a minimum.

This ready assembly and disassembly capability is achieved by a novel structure used to form a hinge connection between the base and the clamp member. The base is comprised of arcuate end members that extend partially about portions of a tubing string adjacent the ends of a coupling and semicircular hinge grooves are formed in the outer surface of the end members to receive hinge elements that are formed on arcuate clamp sections of which the clamp member is comprised. More particularly, a recess that intersects the hinge grooves is formed in one end of each base end member and the hinge elements are formed on portions of the clamp sections that extend through the recess so that the hinge elements can be cradled in the hinge grooves. The hinge elements are connected to each other by a hinge rod extending along the common axis of the hinge elements and a projection is formed on a structure that connects the base end members to extend partially about central portions of the hinge rod in the assembled guard. Assembly is effected by forcing the hinge elements along the outer surface of the base end members toward the hinge grooves while forcing the hinge rod against the projection and bowing the hinge rod toward the distal end of the projection to cause the hinge rod to move over the end of the projection while the hinge members simultaneously snap into position into the hinge grooves. Disassembly is effected by engaging portions of the hinge rod adjacent the projection with a prying implement, which may be a large screw driver, and using the implement to bow the hinge rod toward the distal end of the projection while simultaneously lifting the hinge rod to cause the hinge elements to lift from the hinge grooves in the outer surface of the base end members as the hinge rod clears the distal end of the projection. Consequently, should either the base or the clamp member be worn or damaged to the point that it is of no further use, only that part of the guard must be discarded; any part that is still serviceable can be returned to stock for use in the assembly of a new guard.

Costs of installation of the cable guard are minimized by adapting the rod and projection structure used to secure the clamp sections to the base end members to fastening free ends of the clamp sections to free ends of the base end members when a guard is mounted on a coupling. In particular, bolt grooves that parallel the hinge grooves are formed in the outer surface of the base end members adjacent free ends that are opposite the ends of such members in which the hinge grooves are formed and the base portion of a u-bolt is mounted in the bolt grooves and secured therein by a projection on the connecting structure of the base member that extends partially about central portions of the base portion of the u-bolt. As in the case of the hinge rod, the base portion of the u-bolt is bowed about the projection to snap the ends of the base portion of the u-bolt into the bolt grooves and the u-bolt can be removed by prying central portions of the base portion of the bolt about the distal end of the projection. Recesses cut into the free ends of the base end members and the clamp sections pass threaded leg portions of the u-bolt so that such free ends can be fastened together via suitable nuts screwed onto the legs of the u-bolt. With such construction of the cable guard, installation of the guard on a tubing string is readily effected by passing the electrical cables through the channels provided therefor in the base, mating the inner surfaces of the base end members with portions of the tubing string adjacent opposite ends of a coupling and swinging the clamp sections into a closed position in which the clamp sections and base end members encircle the portions of the tubing string adjacent the ends of the coupling. The u-bolt is then rotated to pass the legs of the u-bolt through the recesses in the free ends of the base end members and clamp sections to hold the guard on the tubing string while nuts are threaded onto the legs of the u-bolt to securely mount the guard, with the electrical cables enclosed, about the coupling.

An important object of the present invention is to limit operating costs of oil wells in which production is effected by downhole electrical pumps.

Another object of the invention, in furtherance of the above object, is to minimize acquisition costs of guards that are used to protect electrical cables extending to the downhole pumps.

Yet a further object of the invention is to minimize the costs of installing cable guards on a tubing string leading to a downhole electrical pump that receives electrical power via cables extended along the tubing string.

Other objects, features and advantages of the present invention will become apparent from the following detailed description when read in conjunction with the drawings and appended claims.

DESCRIPTION OF THE PREFERRED EMBODIMENT

Figure 1:
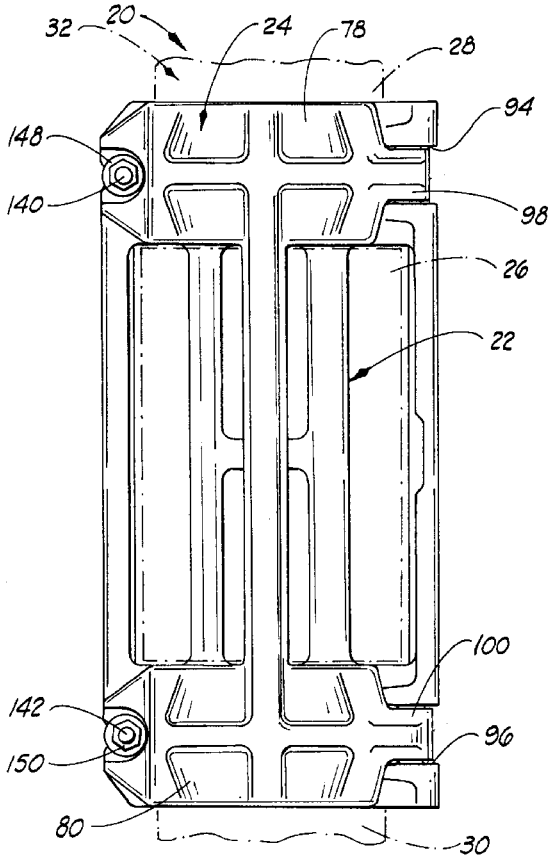
FIG. 1 is a front elevation of a cable guard constructed in accordance with the present invention.
Figure 2:
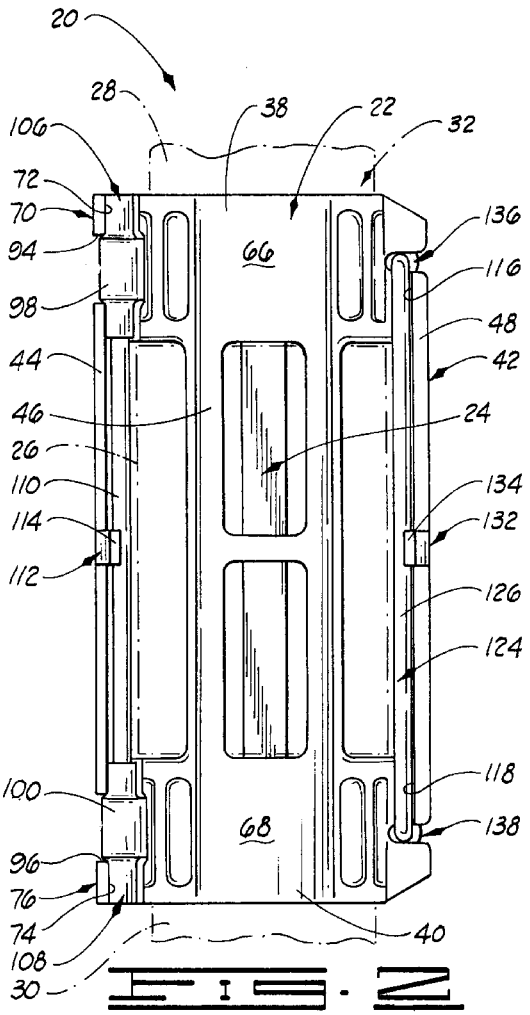
FIG. 2 is a rear elevation of the cable guard shown FIG. 1.
Figure 3:
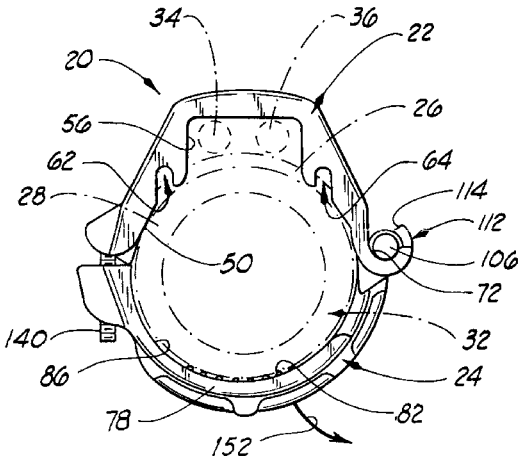
FIG. 3 is a top view of the cable guard shown in FIG. 1.

Referring now to the drawings in general and to FIGS. 1 through 3 in particular, shown therein and designated by the general reference numeral 20 is a cable guard constructed in accordance with the present invention. The cable guard 20 is generally comprised of a base 22, more particularly illustrated in FIGS. 4 through 8, and a clamp member 24, more particularly illustrated in FIGS. 9 and 10, that are hingedly interconnected in a manner to be described below to fit about a coupling 26 between two tubes 28, 30 of a tubing string 32. As will also be described below, provision is made in the construction of the base 22 for protectively surrounding cables, such as cables 34 and 36 shown in dashed line in FIG. 3, that extend along the tubing string 32 to a downhole electrical pump (not shown) as the cables pass alongside the coupling 26.

Figure 4:
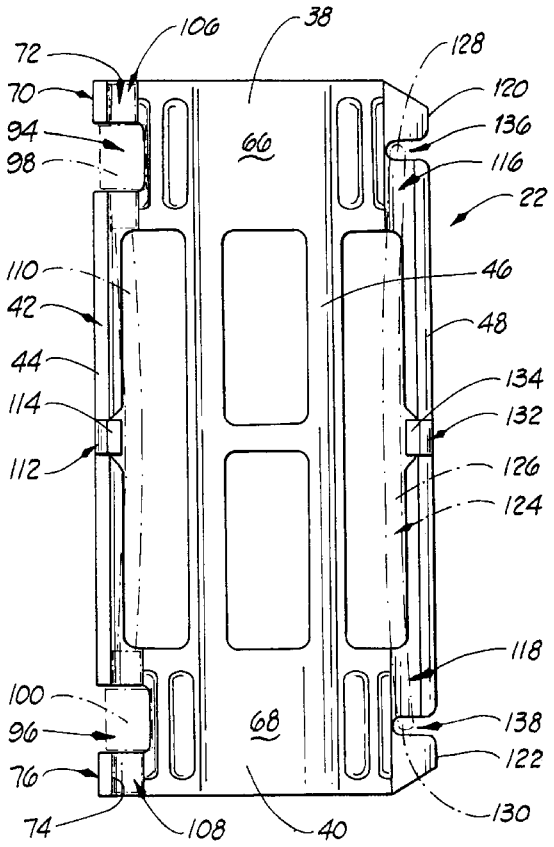
FIG. 4 is a rear elevation of base of the cable guard shown FIG. 1.
Figure 5:
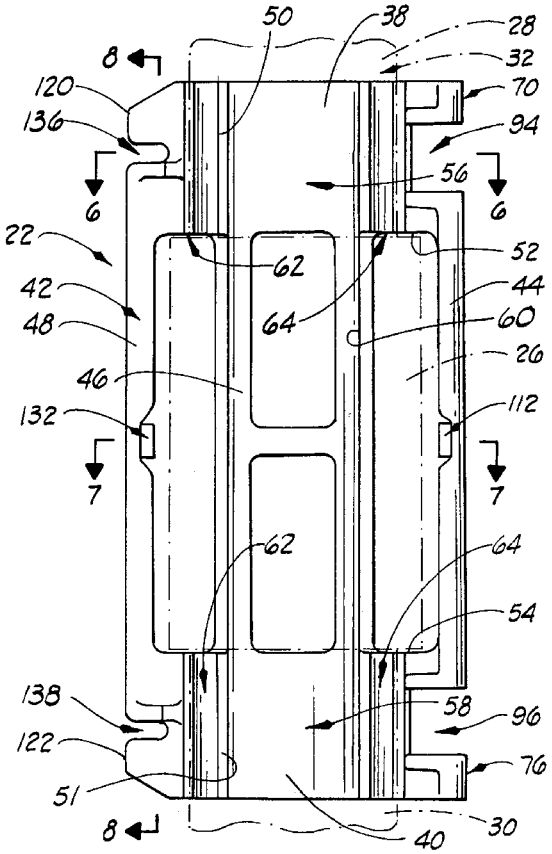
FIG. 5 is a front elevation of the base shown in FIG. 4.
Figure 6:
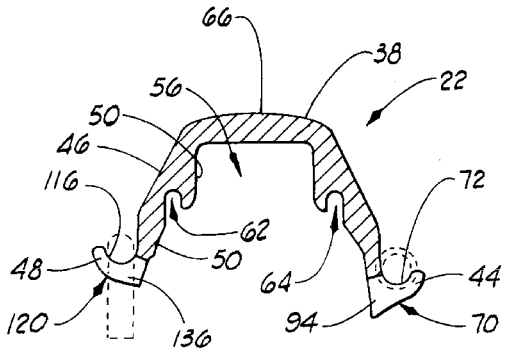
FIG. 6 is a cross section of the base along line 6—6 of FIG. 5.
Figure 7:
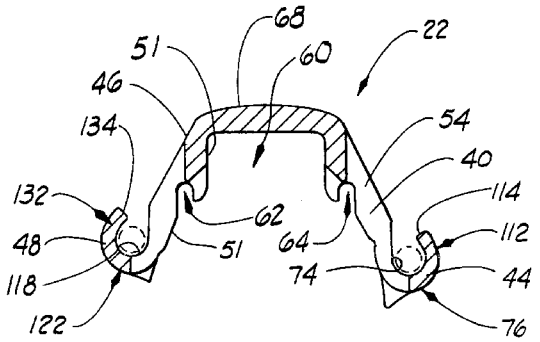
FIG. 7 is a cross section of the base along line 7—7 of FIG. 5.

As noted above, the base 22, which is preferably fabricated as a ductile iron sand casting, has been more particularly illustrated in FIGS. 4 through 8 to which attention is now invited. As illustrated in front and rear elevation in FIGS. 5 and 4 respectively, the base 22 is comprised of first and second base end members, 38 and 40 respectively, at opposite ends of the base 22 and the base end members 38, 40 are interconnected by an assembly, generally indicated at 42, of longitudinally extending connecting ribs 44, 46 and 48. As shown in FIGS. 5 through 7, the base end members 38 and 40 have inner surfaces 50 and 51, respectively, and the base members 38 and 40 have a generally arcuate configuration so that the inner surfaces 50, 51 will mate with the peripheries of the tubes 28 and 30 as has been illustrated in FIG. 3 for the inner surface 50 and tube 28. The lengths of the ribs 44, 46 and 48 are selected with respect to the length of the coupling 26 and are positioned with respect to the inner surface 50 such that the ribs 44, 46 and 48 and facing surfaces 52 and 54, formed on the end members 38 and 40 respectively, will form a cage like structure that will enclose and capture the coupling 26 at such times that the cable guard is mounted on the tubing string 32 in the manner that has been illustrated in FIG. 3.

The rib 46 of the connecting assembly 42 is aligned with central portions of the base end members 38 and 40 and, as shown in FIGS. 5 through 7, longitudinal channels 56 and 58 are formed by the inner surfaces 50 and 51, respectively, of the base end members 38 and 40 in alignment with the rib 46 and extend along the rib 46 as shown at 60 in FIGS. 5 and 7. When the cable guard 20 is mounted on a tubing string 32 as illustrated in FIG. 3, the channels 56, 58 and 60, and the peripheries of the tubes 28 and 30 and the coupling 26, form a conduit that extends along the coupling for protectively enclosing cables 34, 36 leading to the downhole pump (not shown) at the end of the tubing string. Additional channels may be longitudinally formed in the inner surfaces of the base end members 38 and 40, as illustrated by the channels 62 and 64 in the inner surfaces 50 and 51 of base end members 38 and 40, to similarly provide protective enclosure of additional cables; for example, control cables such as that extend along the tubing string to the downhole pump as these cables pass the coupling 26.

Extending about the inner surfaces 50 and 51, the base end members 38 and 40 have outer surfaces indicated at 66 and 68 respectively in FIGS. 4 and 6. Adjacent a hinge end 70 of the first base end member 38, a semicircular hinge groove 72 is formed in the outer surface 66 of the base first end member 38 and a hinge groove 74 is similarly formed in the outer surface 68 of the base end member 40 adjacent a hinge end 76 of the base end member 40. As shown in FIG. 2, the hinge grooves 72 and 74 extend longitudinally with respect to the longitudinal extent of the guard 20 to parallel the axis of the tubing string 32 and, as additionally shown in FIG. 4, the hinge grooves 72 and 74 are formed in the base end members 38 and 40 respectively in coaxial alignment with each other. The hinge grooves 72 and 74 are part of a hinge assembly, not generally designated numerically in the drawings, that is formed partially on the base 22 and partially on the clamp member 24 which will now be described with reference to FIGS. 9 and 10.

Figure 9:
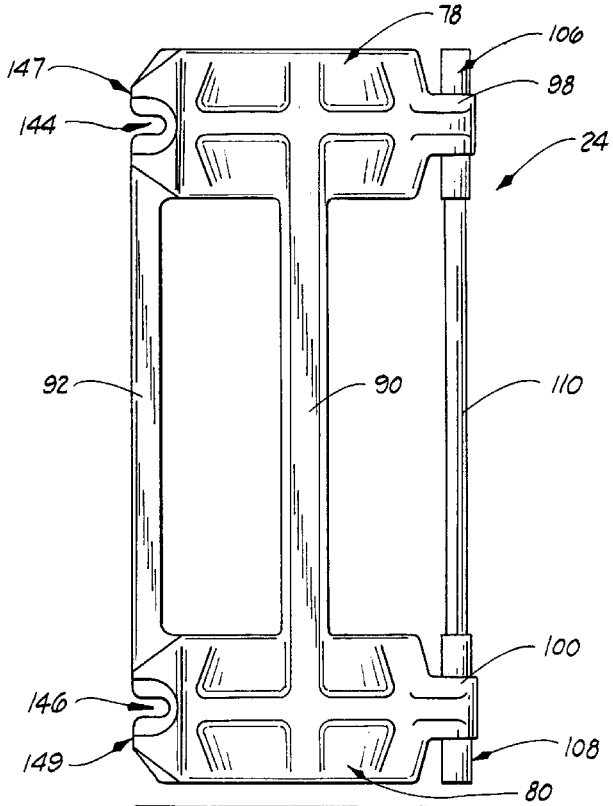
FIG. 9 is a front elevation of the clamp member of the cable guard shown in FIG. 1.
Figure 10:
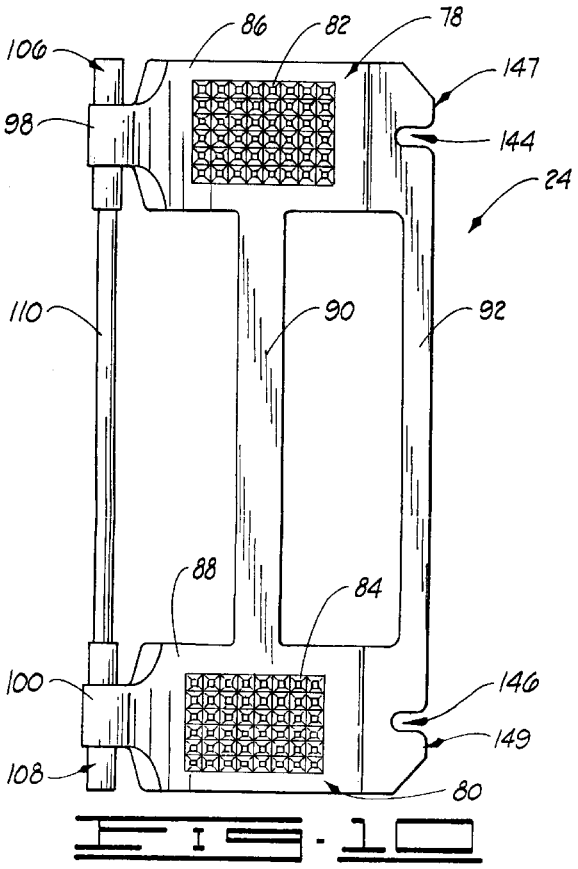
FIG. 10 is a rear elevation of clamp member shown in FIG. 9.
Figure 11:
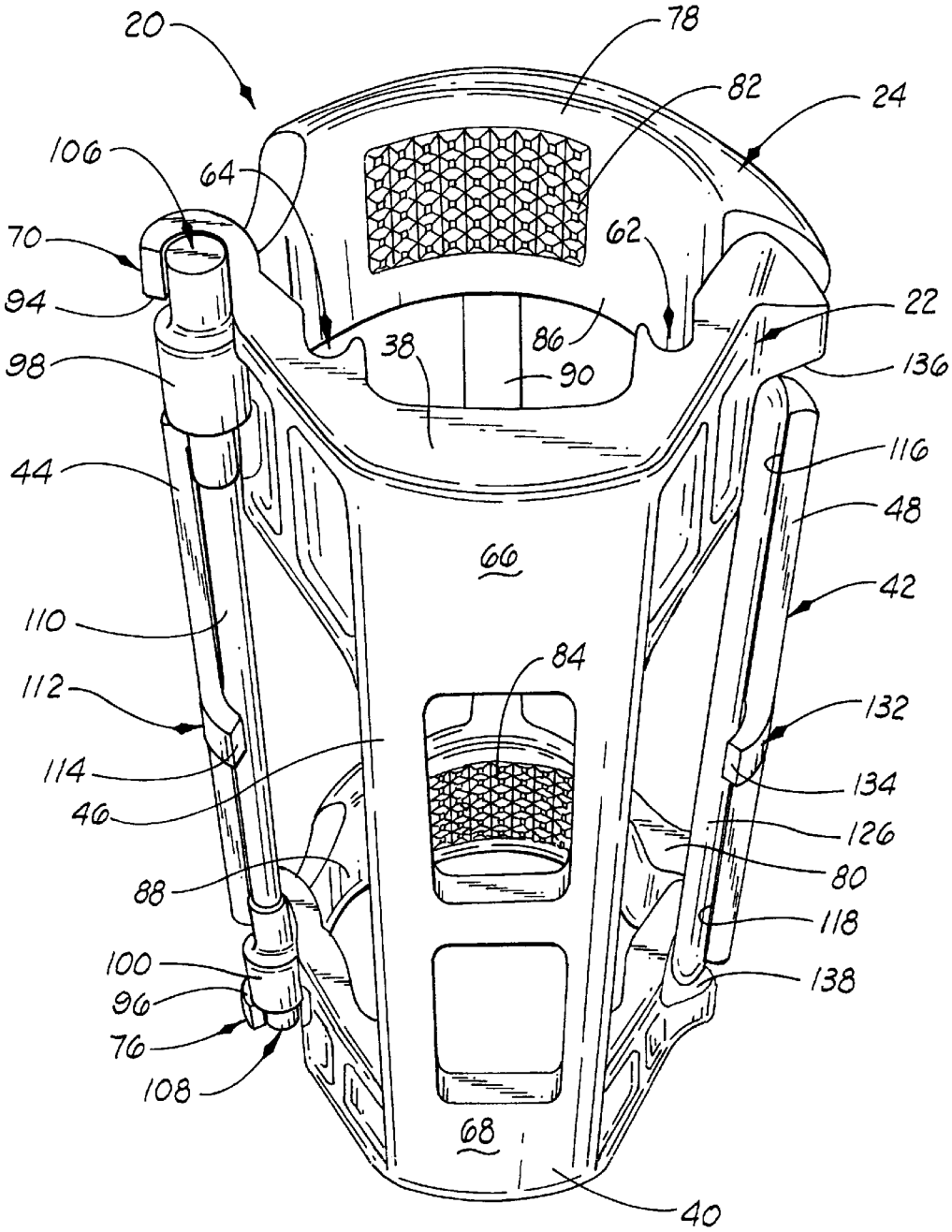
FIG. 11 is a perspective view of the cable guard shown in FIG. 1.

As shown in FIGS. 9 and 10, the clamp member 24 which, like the base 22, is preferably a ductile iron sand casting, is generally comprised of first and second clamp sections, 78 and 80 respectively. As illustrated for the first clamp section 78 in FIG. 3, the clamp sections are arcuate members that, when the guard 20 is mounted on a tubing string 32, extend about portions of the tubes 28 and 30 (see also FIG. 1) on the side of the tubing section opposite the side engaged by the base 22 so that the clamp sections 78 and 80 coact with the base end members 38 and 40 respectively to encircle portions of the tubes 28 and 30 adjacent the ends of the coupling 26. Thus, the cable guard 20 can be securely mounted on the tubing string 32, as will be described below, to protectively channel cables, such as the cables 34 and 36 shown in FIG. 3, along the coupling 26.

Returning to FIG. 10, a rectangular array of projecting, substantially pyramidal gripping elements 82 and 84 are formed on the cylindrically concave inner surfaces, 86 and 88 respectively, of the clamp sections 78 and 80 respectively; that is, the gripping elements 82 and 84 are formed on the surfaces of the clamp sections that will face the tubing string when the cable guard 20 is mounted on the tubing string 32. As indicated for the gripping elements 82 and the tube 28 in FIG. 3, these gripping elements are driven into surface irregularities in the tubes 28 and 30 when the cable guard 20 is mounted on the tubing string 32 as described below to fix the position of the cable guard on the tubing string 32 and fix the position of the cables to the downhole pump as the cables are channeled past the coupling 26 by the cable guard 20.

Returning to FIGS. 9 and 10, the clamp sections 78 and 80 are spaced apart so that the first clamp section 78 can be aligned with the first base end member 38 of the base 22 while the second clamp section 80 is aligned with the second base end member 40. Ribs 90 and 92 are formed integrally with the clamp sections 78 and 80 and extend therebetween.

Returning to FIGS. 4 and 5 and with continuing reference to FIGS. 9 and 10, hinge recesses 94 and 96 are formed through portions of the base end members 38 and 40 adjacent the hinge ends 70 and 76 thereof. The common axis of the hinge grooves 72 and 74 formed in the outer surfaces 66 and 68 of the base end members 38 and 40 extends through and intersects the hinge recess 94 and 95. Correspondingly, hinge portion 98 and hinge portion 100 of the clamp sections 78 and 80, respectively, are sized to fit within the recesses 94 and 96 as has been particularly illustrated in FIGS. 1 and 2. Cylindrical hinge elements 106 and 108 are formed on the hinge portion 98 and hinge portion 100, respectively, of the clamp sections 78 and 80 to extend into and mate with the hinge grooves 72 and 74 formed in the outer surfaces 66 and 68 of the base end members 38 and 40, respectively. As shown in FIG.2, the hinge elements 106 and 108 are comprised of portions that extend from the hinge portion 98 and hinge portion 100 of the clamp sections 78 and 80 into the hinge grooves 72 and 74.

In the practice of the invention, the hinge elements are connected by a hinge rod 110 and a curving projection 112 is formed on central portions of the rib 44 of the base 22 to extend partially about central portions of the hinge rod 110 at such times that the hinge elements 106 and 108 are mated with the hinge grooves 72 and 74 to prevent dislodgement of the hinge elements 106 and 108 from the grooves 72 and 74. As can be seen in FIG. 4, the distal end of the projection 112 is substantially aligned with the axes of the grooves 72 and 74 so that the projections 112 will overlay approximately half the rod 110 in the assembled cable guard 20 as shown in FIG. 2. As further shown in FIGS. 2, 4 and 7, a face 114 is formed on the end of the projection 112 to slope generally toward the axis of the grooves 72 and 74 as has been particularly indicated for the groove 74 in FIG. 7. The purpose of the face 114 will become clear below.

Figure 8:
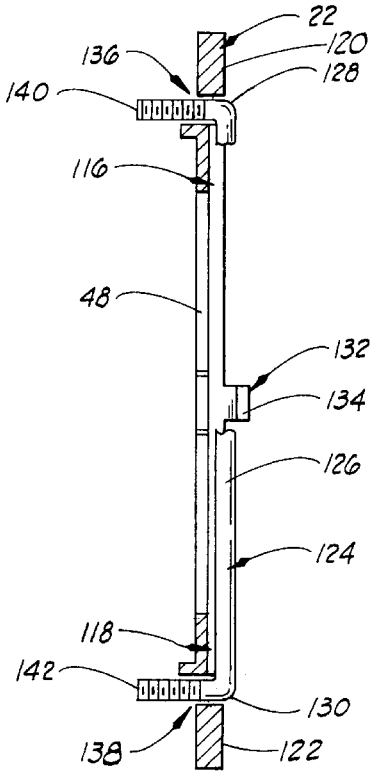
FIG. 8 is a cross section of the base in partial cutaway along line 8—8 of FIG. 5.

With continuing reference to FIG. 4 and additional reference to FIG. 8, coaxial bolt grooves 116 and 118 are formed in portions of the outer surfaces 66 and 68 of the base end members 38 and 40 respectively adjacent free ends 120 and 122. As shown in FIG. 8, the cable guard 20 has a clamp securing assembly that is comprised of a u-bolt 124 having a base portion 126 and ends 128 and 130, the base portion 126 being positioned in the bolt grooves 116 and 118 in the assembled cable guard 20. As illustrated in FIGS. 2 and 8, an arcuate projection 132 is formed on central portions of the rib 48 of the base connecting assembly 42 to extend partially about central portions of the base portion 126 of the u-bolt 124 to prevent dislodgement of the u-bolt from the bolt grooves 116, 118 in the same manner that the projection 112 engages the hinge rod 110 to maintain the hinge elements 106 and 108 in the hinge grooves 72 and 74 that has been described above. As in the case of the projection 112 and hinge rod 110, the projection 132 overlays substantially half the u-bolt base portion 126 and, further, has an angled face 134 formed on the distal end thereof.

Returning to FIG. 4, bolt recesses 136 and 138 are formed through portions of the base end members 38 and 40 adjacent the free ends 120 and 122 of the members 38 and 40, the recesses 136 and 138 extending inwardly from the free ends to intersect the common axis of the bolt grooves 116 and 118. As shown in FIG. 8, the bolt recesses 136 and 138 pass threaded leg portions 140 and 142 of the u-bolt 124 through portions of the base end members 38 and 40 adjacent the free ends 120 and 122 of the base end members. As shown in FIGS. 9 and 10, the clamp sections 78 and 80 are similarly provided with bolt recesses 144 and 146 extending inwardly from their free ends 147 and 149 through which the leg portions 140 and 142 can be passed, as indicated in FIGS. 1 and 2, when the cable guard 20 is placed in a closed position about the tubing string 32 shown in FIG. 3. Nuts 148 and 150 are threaded onto the leg portions 140 and 142 of the u-bolt 124 to secure the free ends of the clamps sections 78 and 80 to the free ends of the base end members 38 and 40 when the cable guard is mounted on the tubing string 32 in the manner discussed below.

Assembly and Mounting of the cable Guard

The manner in which the cable guard is assembled is illustrated in FIG. 4. As indicated in broken lines therein, assembly of the clamp member 24 to the base 22 is effected by positioning the hinge portion 98 and hinge portion 100 of the clamp sections 78 and 80 into the hinge recesses 94 and 96, respectively; this will cause the hinge elements 106 and 108 to be set in the hinge grooves 72 and 74. Pressure exerted on the hinge portion 98 and hinge portion 100 of the clamp sections 78, 80 will then drive the hinge portion 98 and hinge portion 100 of the clamp sections so that central portions of the hinge rod 110 will engage the angled face 114 on the projection 112 and be bowed thereby. As the bowing continues, the central portions of the hinge rod 110 will reach the projection 112 and further movement of the hinge portion 98 and hinge portion 100 of the clamp sections 78, 80 will cause the hinge rod to snap around the projection 112 while, at the same time, the hinge elements 106 and 108 are seated in the hinge grooves 72 and 74. Disassembly of the clamp member 24 from the base 22 can be effected by inserting a screw driver or other suitable prying implement between the rib 42 and central portions of the hinge rod 110 and forcing the hinge rod upwardly and toward the projection 112.

The u-bolt 124 is similarly assembled on the base 22 by disposing near the ends 128 and 130 near the bolt grooves 116 and 118. Then central portions of the u-bolt base portion 126 must be bowed inwardly against the face 134 on the projection 132 until the base portion 126 of the u-bolt 124 clears the projection 132 while the ends 128 and 130 seat in the bolt grooves 116 and 118. Disassembly of the u-bolt 124 from the base 22 is effected by bowing it to clear the projection 132 and removing the ends 128 and 130 from the bolt grooves 116 and 118.

To mount the cable guard 20 on a tubing string 32, the hinge elements 106 and 108 of the clamp section 24 are pivoted in the hinge grooves 72 and 74 to cause the clamp section 24 to move in the direction indicated at 152 in FIG. 3 with respect to the base 22 that the connecting assembly 42 can be positioned about the coupling 26. Cables to be protected are then placed in the channels 56 through 60 and the base 22 is placed on the coupling 26. The clamp member 24 is then moved to the position shown in FIG. 3 and the u-bolt is positioned so as to extend the leg portions 140 and 142 thereof through the bolt recesses 136, 138, 144 and 146 in the free ends of the base end members and clamp sections and nuts 148 and 150 are threaded onto the leg portions 140 and 142 of the u-bolt 124, preferably after placing suitable washers on the leg portions 140 and 142, to secure the free ends of the base members to the free ends of the clamp members and thereby secure the cable guard 20 on the tubing string 32 with cables to the downhole pump enclosed within the channels 56, 58 and 60 in the base member 22.

It will be clear that the present invention is well adapted to carry out the objects and attain the ends and advantages mentioned as well as those inherent therein. While a presently preferred embodiment has been described for purposes of this disclosure, numerous changes may be made which will readily suggest themselves to those skilled in the art and which are encompassed in the spirit of the invention disclosed and as defined in the appended claims.

What is claimed is:

1. A cable guard for protecting a cable extending along a tubing coupling between successive tubes of a tubing string, comprising:

a base for mounting on the tubing string about one side of a tubing coupling, the base comprising:

arcuate first and second base end members, each of said first and second base end members partially circumferentially extendable about portions of a tube adjacent one end of said tubing coupling at such times that the cable guard is mounted on said tubing string, wherein each of said first and second base end members is characterized as having an inner surface configured to partially mate with a periphery of said tube in the mounted condition of the cable guard on said tubing string, and each of said first and second base end members having a longitudinal channel formed in its inner surface for guiding at least one cable along said tubing coupling in said mounted condition, wherein each of said first and second base end members is further characterized as having an outer surface extending arcuately about said inner surface; and base end member connection means extendable about said tubing coupling in said mounted condition of the cable guard for providing a rigid connection between the first and second base end members;

clamping means for securing the base to said tubing string in said mounted condition, the clamping means comprising an arcuate first clamp section coactive with the first base end member for securing the cable guard about portions of said tubing string adjacent one end of said tubing coupling and an arcuate second clamp section coactive with the second base end member for securing the cable guard about portions of said tubing string adjacent an opposite end of said tubing coupling;

wherein a semicircular hinge groove is formed in the outer surface of each of said first and second base end members adjacent a hinge end of said first and second base end members, the hinge groove of said first base end member being coaxially aligned with the hinge groove of said second base end member;

wherein a hinge recess extending to said hinge groove is formed in the hinge end of each of said first and second base end members;

wherein a hinge portion of the first clamp section adjacent said hinge end thereof is positioned within the hinge recess formed in the hinge end of the first base end member;

wherein a hinge portion of the second clamp section adjacent said hinge end thereof is positioned within the hinge recess formed in the hinge end of the first base end member;

wherein a cylindrical hinge element is formed on the hinge portion of the first clamp section within the hinge recess of the first base end member extending into and mating with the hinge groove of said first base end member;

wherein a cylindrical hinge element is formed on the hinge portion of the second clamp section within the hinge recess of the second base end member extending into and mating with the hinge groove of said second base end member;

wherein a bolt groove is formed in the outer surface of each of said first and second base end members adjacent each of the free ends, the bolt groove of said first base end member is coaxially aligned with the bolt groove of said second base end member;

wherein a bolt recess extending to the bolt groove is formed in the free end of each of said first and second base end members, the bolt recess extending between said inner and outer surfaces of said first and second base end members;

wherein another bolt recess is formed through portions of each of the first and second clamp sections adjacent the free ends thereof and aligning with the bolt recess formed in whichever of said first and second base end member with which said each of said first and second clamp sections coacts in securing the cable guard on said tubing string; and wherein the cable guard further comprises:

a hinge rod formed coaxially with the cylindrical hinge elements of the arcuate first and second clamp sections and extending therebetween;

a projection formed on the base end member connection means extending partially about central portions of the hinge rod to secure the hinge members within the hinge grooves; and clamp securing means for securing free ends of the clamp sections, opposite the hinge ends of the first and second base end members, to free ends of said base opposite said hinge ends of said base, said clamp securing means coprising:

a u-bolt comprising a base portion and threaded leg portions extending laterally therefrom, wherein portions of the u-bolt base portion are disposed within the bolt grooves of the base end members whereby the leg portions of the u-bolt can be extended through said bolt recesses;

nuts threadable onto the leg portions of the u-bolt leg portions for securing the free ends of the clamp sections to the free ends of said first and second base end members; and another projection formed on the base end member connection means of the base extending partially about central portion of the base portion of the u-bolt coacting with the bolt grooves to secure the u-bolt to the base.

2. The cable guard of claim 1 wherein each of the first and second clamp sections is characterized as having a cylindrically concave inner surface facing said tubing string at such times that the cable guard is mounted on said tubing string; and wherein a plurality of projecting gripping elements are formed on the inner surface of each of the first and second clamp sections to engage surface irregularities in said tubes of said tubing string.

3. A cable guard for protecting a cable extending along a tubing coupling between successive tubes of a tubing string, comprising;

a base for mounting on the tubing string about one side of a tubing coupling, the base comprising:

arcuate first and second base end members, each of said first and second base end members partially circumferentially extendable about portions of a tube adjacent one end of said tubing coupling at such times that the cable guard is mounted on the tubing string, wherein each of said first and second base end members is characterized as having an inner surface configured to partially mate with a periphery of said tube in the mounted condition of the cable guard on the tubing string and each of said first and second base end members having a longitudinal channel formed in its inner surface for guiding at least one cable along said tubing coupling in said mounted condition, wherein each of said first and second base end members is further characterized as having an outer surface extending arcuately about said inner surface; and base end member connection means extendable about said tubing coupling in said mounted condition of the cable guard for providing a rigid connection between said first and second base end members;

clamping means for securing the base to said tubing string in said mounted condition, the clamping means comprising an arcuate first clamp section coactive with the first base end member for securing the cable guard about portions of the tubing string adjacent one end of a tubing coupling and an arcuate second clamp section coactive with the second base end member for securing the cable guard about portions of the tubing string adjacent the opposite end of said tubing coupling; and means formed partially on the base and partially on the clamping means for forming hinge connections between said first and second clamp sections and each of said first and second base end members adjacent hinge ends of each of said first and second clamp sections and each of said first and second base end members;

wherein a bolt groove is formed in the outer surface of each of said first and second base end members at a free end thereof opposite the hinge ends of each of said first and second base end members, the bolt groove in said first base end member coaxially aligning with the bolt groove in said second base end member;

wherein a bolt recess extending to the bolt groove is formed in the free end of each of said first and second base end members, said bolt recess extending between the inner and outer surfaces of each of said first and second base end members;

wherein another bolt recess is formed through each of said first and second clamp sections to align with said bolt recesses formed in each of said first and second base end members with which each of said first and second clamp sections coacts in securing the cable guard on said tubing string; and wherein the cable guard further comprises:

a u-bolt comprising a base portion and threaded leg portions extending laterally from the base portion, portions of the u-bolt base portion disposed within the bolt grooves of said first and second base end members whereby the leg portions of the u-bolt can be extended through said bolt recesses of said first and second clamp sections;

nuts threadable onto the threaded leg portions of the u-bolt for securing the free ends of said first and second clamp sections to the free ends of said first and second base end members; and a projection formed on the base end member connection means extending partially about central portions of the base portion of said u-bolt to coact with said bolt grooves to secure said u-bolt to the base.

4. The cable guard of claim 3 wherein each of said first and second clamp sections is characterized as having a cylindrically concave inner surface facing said tubing string when the cable guard is mounted on said tubing string; and wherein a plurality of projecting gripping elements are formed on the inner surface of each said arcuate first and second clamp sections to engage surface irregularities in tubes of the tubing string.

* * * * *

UNITED STATES PATENT AND TRADEMARK OFFICE

CERTIFICATE OF CORRECTION

PATENT NO. : 6,023,027
DATED : February 8, 2000
INVENTOR(S) : Scott E. Neff

It is certified that error appears in the above-identified patent and that said Letters Patent is hereby corrected as shown below:

Column 3,
Line 55, replace "Brief Description of the Drawing" with -- Brief Description of the Drawings --

Column 5,
Lines 2 and 3, replace "cables; for example, control cables such as that extend" with -- cables, such as for example, control cables that extend --

Column 7,
Line 31, replace "Disassembly of the u-bolt 124" with -- Removal of the u-bolt 124 --

Column 9,
Line 20, replace "means coprising:" with -- means comprising: --

Signed and Sealed this

Tenth Day of September, 2002

*Attest:*

*Attesting Officer*

JAMES E. ROGAN
*Director of the United States Patent and Trademark Office*